United States Patent [19]

Abe et al.

[11] Patent Number: 4,527,530

[45] Date of Patent: Jul. 9, 1985

[54] METHOD FOR CORRECTING A CONTROLLED VARIABLE FOR THE CONTROL OF THE OPERATION OF AN INTERNAL COMBUSTION ENGINE ON THE BASIS OF THE QUANTITY OF SUCTION AIR

[75] Inventors: Tomoaki Abe, Oobu; Masumi Kinugawa, Okazaki; Shunichiro Hiromasa, Kariya, all of Japan

[73] Assignee: Nippondenso Co., Ltd., Kariya, Japan

[21] Appl. No.: 558,191

[22] Filed: Dec. 5, 1983

[30] Foreign Application Priority Data

Dec. 7, 1982 [JP] Japan ..... 57-215297

[51] Int. Cl.[3] ..... F02M 51/00

[52] U.S. Cl. ..... 123/494; 73/118

[58] Field of Search ..... 123/494; 73/118, 118 A, 73/204

[56] References Cited

U.S. PATENT DOCUMENTS

| | | | |
|---|---|---|---|
| 3,788,285 | 1/1974 | Gelin et al. | 123/494 |
| 3,818,877 | 6/1974 | Barrera et al. | 123/494 |
| 4,089,214 | 5/1978 | Egami et al. . | |
| 4,334,426 | 6/1982 | Kita et al. | 73/118 |
| 4,386,520 | 6/1983 | Nagaishi | 73/118 |

FOREIGN PATENT DOCUMENTS

| | | | |
|---|---|---|---|
| 124017 | 9/1980 | Japan | 173/118 |
| 92330 | 7/1981 | Japan | 123/494 |
| 156435 | 12/1981 | Japan | 123/494 |

*Primary Examiner*—Parshotam S. Lall

*Attorney, Agent, or Firm*—Cushman, Darby & Cushman

[57] ABSTRACT

In a method for correcting the controlled variable of an engine according to the present invention, the quantity of suction air is measured by means of a thermal type flowmeter. The magnitude of pulsation of the suction air is obtained on the basis of the differential or variation of the measured section air quantity. At the same time, a coefficient representing the susceptibility to the pulsation which depends on the layout of the thermal type flowmeter and the like and the engine speed is calculated. A final correction for correcting the controlled variable is obtained on the basis of the magnitude of the pulsation and the coefficient representing the susceptibility.

7 Claims, 11 Drawing Figures

METHOD FOR CORRECTING A CONTROLLED VARIABLE FOR THE CONTROL OF THE OPERATION OF AN INTERNAL COMBUSTION ENGINE ON THE BASIS OF THE QUANTITY OF SUCTION AIR

BACKGROUND OF THE INVENTION

The present invention relates to a method for correcting a controlled variable for the control of the air-fuel ratio or ignition timing of an internal combustion engine on the basis of the differential of the quantity of suction air of the engine measured by means of thermal type flowmeter.

In controlling the air-fuel ratio (hereinafter referred to as A/F ratio) of an internal combustion engine with high accuracy, it is necessary to obtain an accurate value of the suction air quantity of the engine. It is generally known that the suction air quantity is measured by using a thermal type flowmeter as is disclosed in U.S. Pat. No. 4,089,214.

As the thermal type flowmeter is a kind of mass flowmeter which can measure the mass of airflow, it can accurately measure the quantity of airflow without consideration of the change of temperature or atmospheric pressure. Having good responsiveness without including any mechanical moving parts, moreover, the thermal type flowmeter enjoys an advantage such that it is free from any output errors attributed to mechanical vibrations. Also for this reason, the thermal type flowmeter is suited for the measurement of the suction air quantity of an engine.

However, an output representing the suction air quantity actually measured by means of the thermal type flowmeter is subject to errors attributed to other causes than the aforesaid vibrations, such as pulsation of the suction air as the primary cause. The output errors are expressly noticeable when the engine is in a steady-state, high-load operation mode. Therefore the accurate control of the A/F ratio cannot be obtained, as shown in FIG. 1, because A/F ratio is controlled on the basis of the output of the thermal type flowmeter. In FIG. 1, the ordinate represents A/F ratio error (%) compared with the target value of the A/F ratio, while the abscissa represents the engine speed. As seen from FIG. 1, the A/F ratio greatly deflects from the target value to the rich side in a low engine speed range of about 2,000 rpm and less. In a medium or high engine speed range over 2,000 rpm, on the other hand, the A/F ratio deflects from the targer value to the lean side. This indicates that the thermal type flowmeter delivers an output value representing a suction air quantity greater than the true value in the low engine speed range, affected by the pulsation of the suction air, and that the flowmeter delivers an output value representing a suction air quantity smaller than the true value in the medium or high engine speed range. Accordingly, if the fuel injection quantity of the engine is controlled by the use of the thermal type flowmeter which is subject to such output errors, the drivability and emission performance of the engine will be lowered, causing the catalytic converter to overheat and at last, damage to the engine.

A thermal type flowmeter for a suction air measuring system in an internal combustion engine stated in Japanese Patent Disclosure No. 18721/81 is generally known as a measure to counter the influence of the pulsation of the suction air which causes the aforesaid output errors. In this conventional measuring system, the thermal type flowmeter is attached to an air by-pass for by-passing the suction pipe of the engine, thereby preventing the pulsation of the suction air produced in the suction pipe from affecting the output of the flowmeter. However, this system is subject to a drawback such that the engine is complicated in structure requiring the air by-pass attached to the suction pipe. Moreover, the thermal type flowmeter can measure only the quantity of suction air which flows through the air by-pass, and cannot directly measure the quantity of suction air which actually flows through the suction pipe. Thus, the thermal type flowmeter of this system cannot accurately measure the suction air quantity, exerting the aforementioned bad influence on the engine.

SUMMARY OF THE INVENTION

The object of the present invention is to provide a method for properly correcting a controlled variable of the A/F ratio or ignition timing of an engine after clearing up the causes of output errors of a thermal type flowmeter related to the suction air quantity.

According to the present invention, there is provided a method for correcting a controlled variable for the control of the A/F ratio or ignition timing of an internal combustion engine, which comprises the steps of measuring the quantity of suction air of the internal combustion engine by means of thermal type flowmeter, calculating a differential of the suction air quantity obtained in the measuring process on the basis of a changing characteristic of the suction air quantity, the differential representing the magnitude of pulsation of the suction air, and calculating a correction for correcting the controlled variable on the basis of the differential.

According to the invention, the differential of the measured suction air quantity is obtained on the basis of the changing characteristic of the suction air quantity, so that the magnitude of the pulsation of the suction air can be guessed from the differential. Accordingly, for example, the fuel injection quantity as the controlled variable can be controlled for the target air-fuel ratio by using the correction for compensating the output errors of the thermal type flowmeter which are influenced by the pulsation of the suction air.

According to an aspect of the invention, moreover, the influence of the suction system layout is also taken into accout in calculating the correction, since the output errors of the thermal type flowmeter attributed to the pulsation of the suction air are also influenced by, e.g., the mode of layout of the flowmeter in the suction system. Thus, the correction can be calculated with improved accuracy.

Furthermore, according to another aspect of the invention, the controlled variable is not corrected if the engine is in an unstable-state operation mode, such as a rapid acceleration or deceleration mode, or is not in a high-load operation mode. Thus, incorrect correction can be avoided.

DETAILED DESCRIPTION OF THE PREFERRED EMBODIMENTS

Figure 2:
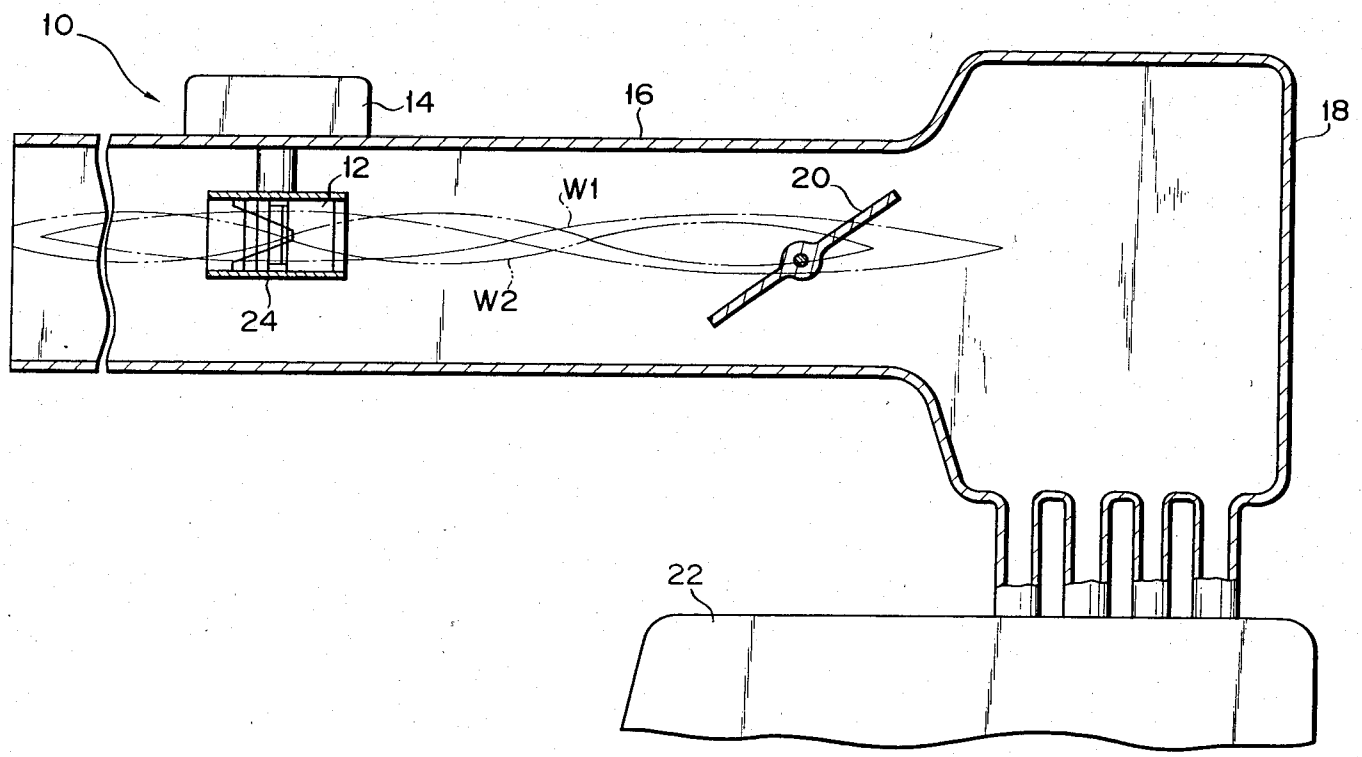
FIG. 2 is a sectional view showing part of a suction system including the thermal type flowmeter.

FIG. 2 shows a layout of a thermal type flowmeter (hereinafter referred to as an HW sensor) 10 in a suction system. The HW sensor 10 is of a conventional type, comprising a sensor section 12 and a detecting section 14. Therefore, detailed description of the construction and principle of the HW sensor 10 is omitted herein. The sensor section 12 is disposed in a suction pipe 16. The suction pipe 16 is open at the left end as in FIG. 2, and is connected at the right end to a surge tank 18. A throttle valve 20 is disposed between the sensor section 12 and the surge tank 18 inside the suction pipe 16. The throttle valve 20 is located close to the surge tank 18.

Figure 1:
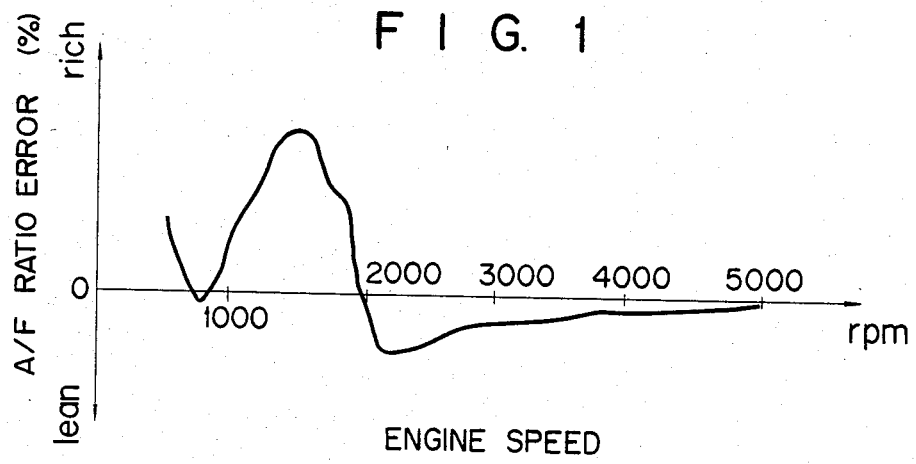
FIG. 1 shows a characteristic curve representing A/F ratio error of an engine in a steady-state, high-load operation mode attributed to output error of a thermal type flowmeter.

In the HW sensor 10 used in the suction system, substantially A/F ratio error as shown in FIG. 1 is caused when an engine 22 is in the steady-state, high-load operation mode, as mentioned before.

After considering various possible causes of the A/F ratio error, the inventors hereof concluded that one of the major causes is pulsation of suction air which is inevitably produced in the suction pipe 16. Namely, the reason why the A/F ratio greatly deflects from the target value to the rich side in the low engine speed range of about 2,000 rpm or less is that the suction air returned as a reverse flow component from the side of the engine 22 is detected also as a forward flow component by the HW sensor 10 due to the pulsation of the suction air, so that the value of suction air quantity meausred by the HW sensor 10 is greater than the true value.

Figure 3:
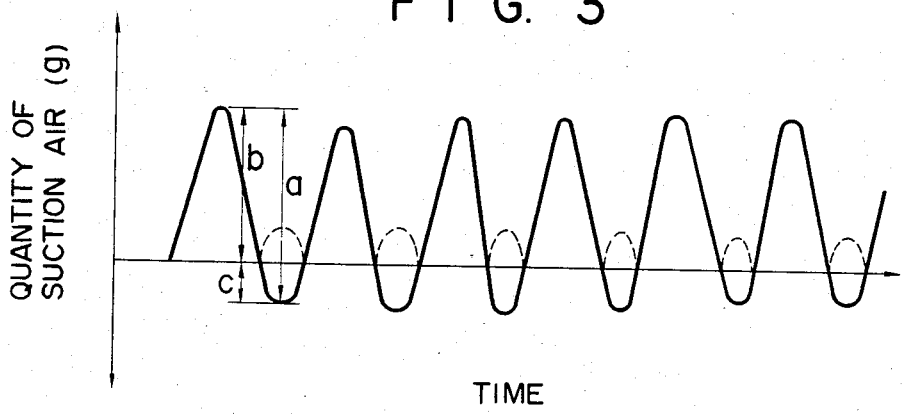
FIG. 3 shows a characteristic curve representing a modeled mode of pulsation of suction air.
Figure 4:
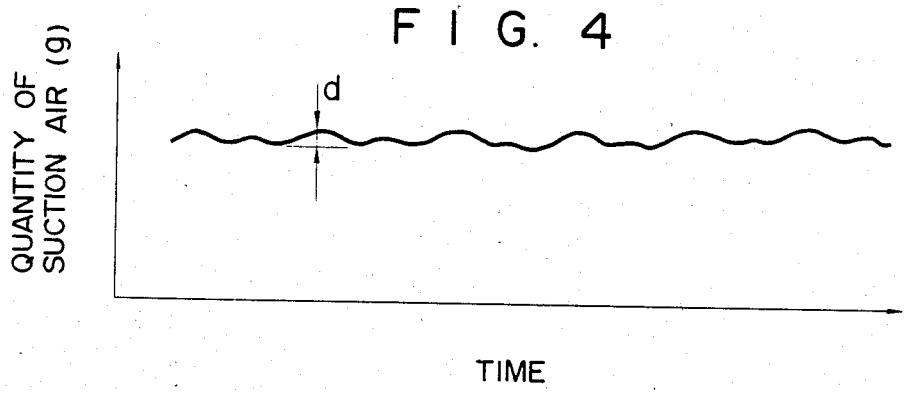
FIG. 4 shows a characteristic curve representing an actual mode of pulsation of the suction air obtained with use of the thermal type flowmeter.

FIG. 3 shows a modeled mode of pulsation of the suction air. Since the HW sensor 10 cannot discriminate the reverse flow component of the suction air from the forward flow component in detecting the suction air quantity, it is practically impossible to measure the amplitude a of the pulsation shown in FIG. 3. In other words, if the HW sensor 10 is regarded as theoretically quite free from response delay, then it detects the reverse flow component of the suction air also as the forward flow component, so that the suction air quantity for the reverse flow component measured by the HW sensor 10 is as indicated by the broken line in FIG. 3. This can actually be ascertained by means of a commercially available hot probe. To meet requirements on workmanship and mechanical strength, however, the speed of response of the HW sensor 10 used in an automobile engine is lowered, and the actual mode of pulsation of the suction air or the suction air quantity output obtained with use of the HW sensor 10 provides a somewhat smoothed waveform, as shown in FIG. 4. In FIG. 4, the amplitude or magnitude d of pulsation is calculated on the basis of ratios between the amplitude a and magnitudes b and c, the response characteristic of the HW sensor 10, and the rotational frequency or speed of the engine 22. The higher the engine speed, the smoother will be the waveform of the pulsation output obtained with use of the HW sensor 10. Accordingly, the pulsation amplitude obtained from the output waveform is reduced. In estimating the true amplitude of pulsation of the suction air, therefore, the influence of the pulsation smoothing action of the HW sensor 10 can be removed by using the differential of the pulsation output provided by the HW sensor 10. The ratio between the forward and reverse flow components of the suction air produced by the pulsation thereof may be considered in association with the pulsation distribution of the suction system, as mentioned later.

It may be attributed to various causes that the A/F ratio deflects from the target value to the lean side in the medium or high engine speed range over 2,000 rpm, as shown in FIG. 1. The flow of the suction air to reach the sensor section 12 of the HW sensor 10 is prevented depending on the mode of pulsation distribution of the suction air, for example. Also, the flow of the suction air to reach the sensor section 12 of the HW sensor 10 may be prevented by a measuring tube 24 (see FIG. 2) of the HW sensor 10. Thus, the value of the suction air quantity measured by the HW sensor 10 is smaller than the true value. For a further detailed description, let us suppose two wave patterns representing the pulsation of the suction air, as indicated individually by a dashed line w1 and a two-dot chain line w2 in FIG. 2. It is known that the wavelengths of the pulsating waves vary with the rotational frequency of the engine 22. Thus, it may be presumed that the susceptibility to pulsation of the suction air varies between the case where the pulsating wave is given by w1 when the rotational frequency Ne of the engine 22 is N1 and the case where the pulsating wave is given by w2 when the rotational frequency Ne is increased to N2 (>N1). If the pulsating wave is such a state as shown w1, the position of the HW sensor 10 corresponds to the loop part of the pulsating wave w1, so that the quantity of suction air to reach the sensor section 12 is large. If the pulsating wave in such a state as shown w2, the position of the HW sensor 10 corresponds to the node part of the pulsating wave w2, so that the quantity of suction air to reach the sensor section 12 is small. It may be presumed that the output of the HW sensor 10 for the medium or high engine speed range is subject to errors for that reason. The pulsation distribution of the actual suction system is more complicated. Since the HW sensor 10 and other elements of the suction system are actually fixed, however, the influence of the pulsation distribution attributed to their layout can be calculated as a function of the rotational frequency Ne of the engine 22.

Thus, in detecting the output errors of the HW sensor 10, it is necessary only to consider the magnitude of pulsation of the suction air and the influence of the pulsation distribution or that of the layout of the HW sensor 10 and other elements, on the rotational frequency Ne of the engine 22. In other words, the output errors of the HW sensor 10 may be detected on the basis of three factors; the magnitude of pulsation of the suction air, the layout of the suction system, and the rotational frequency Ne of the engine 22.

In consideration of these three factors adversely affecting the output of the HW sensor 10, a concrete correcting method will now be described with reference to the flow charts of FIGS. 5 to 7.

Figure 5:
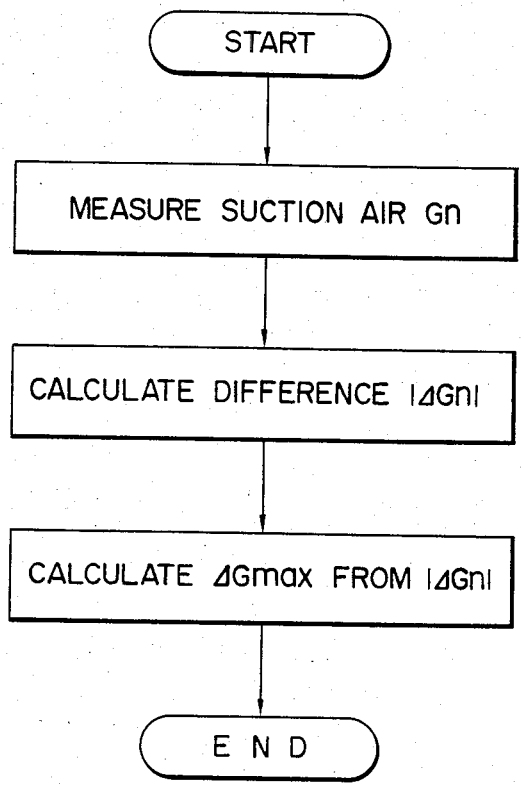
FIGS. 5 to 7 are flow charts for the calculation of corrections.
Figure 8:
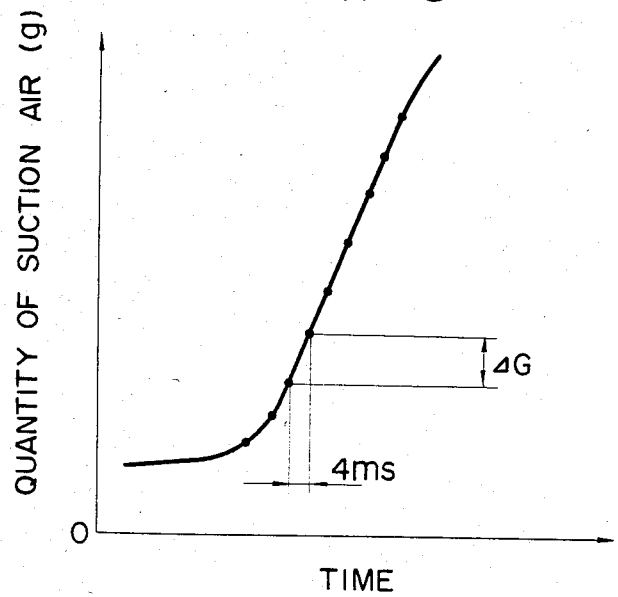
FIGS. 8 and 9 show changing characteristic curves of suction air quantities measured by means of the thermal type flowmeter.

In the flow chart of FIG. 5, the magnitude of pulsation of the suction air is calculated. In this embodiment, the suction air quantity $G_n$ is measured in regular sequence at sampling intervals of 4 milliseconds by the HW sensor 10, as shown in FIG. 8. At the same time, a difference $|\Delta G_n|$ between a suction air quantity $G_{n+1}$ measured this time and a suction air quantity $G_n$ measured the last time ($|\Delta G_n| = |G_{n+1} - G_n|$) is calculated. The difference $|\Delta G_n|$ may be obtained periodically. Since the pulsation of the suction air takes place in synchronism with the rotation of the engine 22, the difference $|\Delta G_n|$ is a value sampled at random among pulsatory variations of the suction air quantity. In calculating the magnitude of pulsation of the suction air on the basis of the difference $|\Delta G_n|$, therefore, it is advisable to use the maximum value ΔGmax of the differences $|\Delta G_n|$ obtained during a period time interval equivalent of an integral multiple ignition interval of the engine. In this case, the period time interval is equal to an ignition interval of the engine. Accordingly, the maximum value ΔGmax is calculated to determined the magnitude of pulsation of the suction air. Actually, the difference $|\Delta G_n|$ is calculated on the basis of electric signals equivalent to the suction air quantities $G_n$ detected by the HW sensor 10, after the electric signals are AD-converted and linearized.

Figure 6:
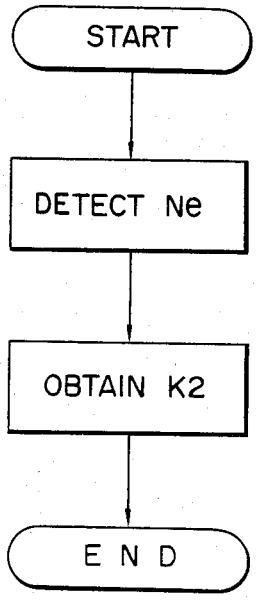

The flow chart of FIG. 6 shows the way that a layout parameter K2 is obtained, the parameter K2 representing the susceptibility of the HW sensor 10 to the pulsation of the suction air. The susceptibility depends on the layout of the HW sensor 10 and other elements. First, the rotational frequency Ne of the engine 22 is detected. The layout parameter K2 is obtained on the basis of the rotational frequency Ne. This may be done by referring to memory in which the parameter K2 corresponding a value of the rotational frequency Ne is recorded, the parameter K2 being peculiar to the suction system of the engine 22 as the results of an experiment. The parameter K2 may also be obtained from some arithmetic formula to which the rotational frequency Ne is put.

Figure 7:
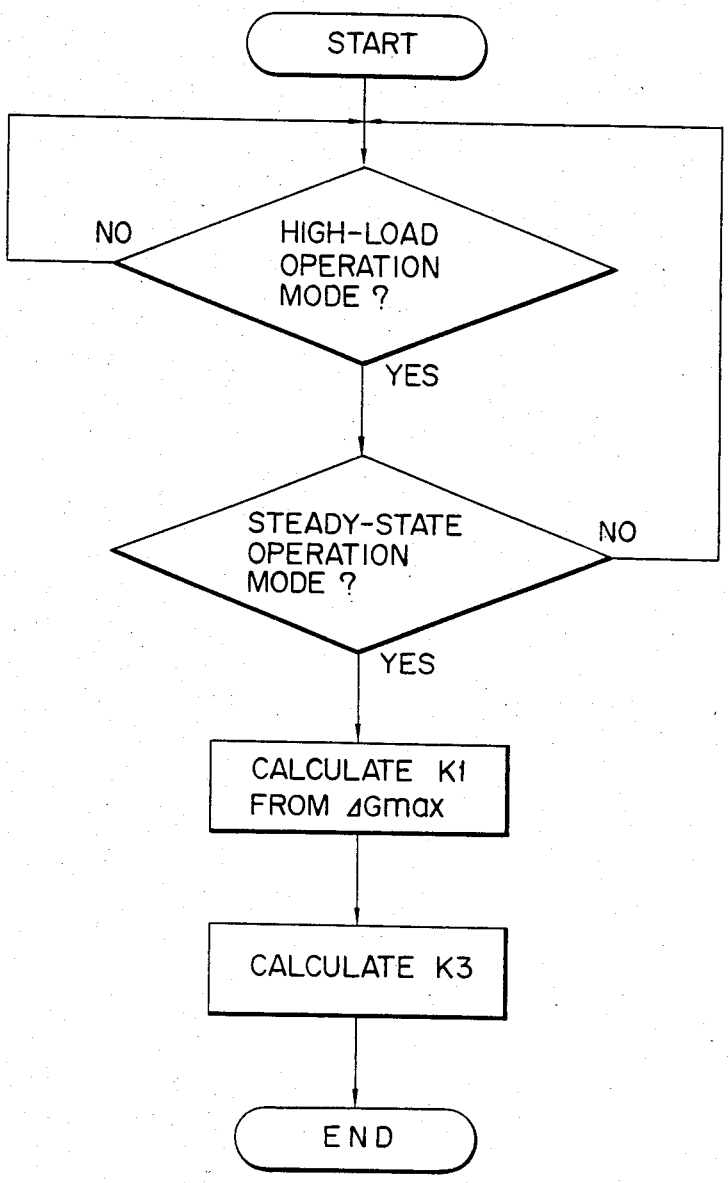

FIG. 7 is a flow chart for calculating a final correction by using the values ΔGmax and K2 obtained in connection with FIGS. 5 and 6. First, a decision is made on whether or not the operation mode of the engine 22 requires correction. Since the noticeable output errors of the HW sensor 10 affected by the pulsation of the suction air are caused mainly when the engine 22 is in the high-load operation mode, as described before, a decision is first made on whether or not the engine 22 is in the high-load operation mode. This decision may be made on the basis of the opening of the throttle valve 20, the rotational frequency Ne of the engine 22, etc.

Figure 9:
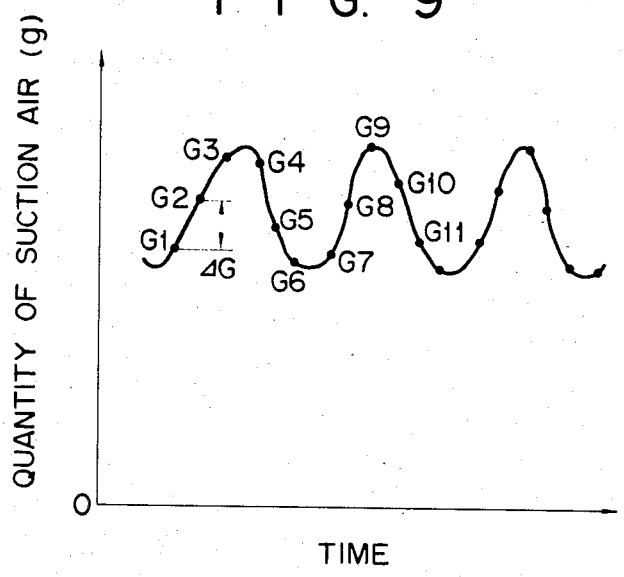

If the engine 22 is found to be in the high-load operation mode, then a decision is made on whether the engine 22 is in the steady-state operation mode or in the unsteady-state operation mode (rapid acceleration or deceleration mode). If the engine 22 is found to be in the unsteady-state operation mode, the value $|\Delta G_n|$ is necessarily large as a consequence. In this case, however, the value $|\Delta G_n|$ does not cause any A/F ratio error. Namely, when the engine 22 is in the unsteady-state operation mode, such as the acceleration or deceleration mode, there is no need of correction becuase the unsteady-state operation mode is a transient state which lasts until the engine 22 goes into the steady-state operation mode. Actually, the decision on whether or not the engine 22 is in the unsteady-state operation mode can be made on the basis of the suction air quantity $G_n$ provided by the HW sensor 10. If suction air quantities sampled between individual injection timings of the engine 22 are G1, G2, . . . , Gi, the difference between each two successive suction air quantities is given by $\Delta G_n = \Delta G_{n+1} - \Delta G_n$. Then, $$\sum_{n=1}^{i} \Delta G_n$$

is calculated. If $$\sum_{n=1}^{i} \Delta G_n > 0,$$

then the engine 22 can be judged to be in the unsteady-state operation mode; if $$\sum_{n=1}^{i} \Delta G_n \approx 0,$$

then in the steady-state operation mode. This may easily be guessed from FIG. 8 showing the changing characteristic curve of the suction air quantity for the unsteady-state operation mode, and FIG. 9 showing that for the steady-state operation mode. Actually, the value $$\sum_{n=1}^{i} \Delta G_n$$

is given by $$\sum_{n=1}^{i} \Delta G_n = (G2 - G1) + (G3 - G2) + \ldots + (G_i - G_{i-1}) = G_i - G1.$$

Thus, whether the value $$\sum_{n=1}^{i} \Delta G_n$$

is positive or substantially zero depends on the difference between G1 sampled just after a fuel injection and $G_i$ sample just before the next fuel injection. The operation mode of the engine 22 may more accurately be judged by making a decision on whether the value $$\sum_{n=1}^{i} \Delta G_n$$

is larger or smaller than a predetermined value C.

Thereafter, if it is concluded that the engine 22 is in the high-load, steady-state operation mode, a coefficient K1 representing the susceptibility of the HW sensor 10 to the pulsation of the suction air is calculated on the basis of the value ΔGmax obtained after the last fuel injection according to the flow chart of FIG. 5. The coefficient K1 is given by $$K1 = \Delta G\max - K_{OFFSET}$$

where $K_{OFFSET}$ is a constant, and the minimum of K1 is zero.

As seen from the above equation, the coefficient K1 can be obtained by offsetting the value ΔGmax for the predetermined value. This is based on the following results of an experiment. If the value ΔGmax representing the magnitude of the pulsation of the suction air is smaller than the predetermined value $K_{OFFSET}$, the reverse flow component of the suction air does not reach the sensor section 12 of the HW sensor 10. If the value ΔGmax is larger than the predetermined value $K_{OFFSET}$, the reverse flow component reaches the sensor section 12 in proportion to $(\Delta Gmax - K_{OFFSET})$. The value K1 may be obtained from memory in which values for K1 depending on the value ΔGmax are recorded, from any other arithmetic formula to which the value ΔGmax is put.

Thereafter, a final correction K3 representing the very A/F ratio error is calculated from the values K1 and K2. In this case, K3 is given by $K3 = K1 \times K2$, since it was ascertained by an experiment that the values K1 and K2 affect the correction K3 is a multiplying manner.

Figure 10:
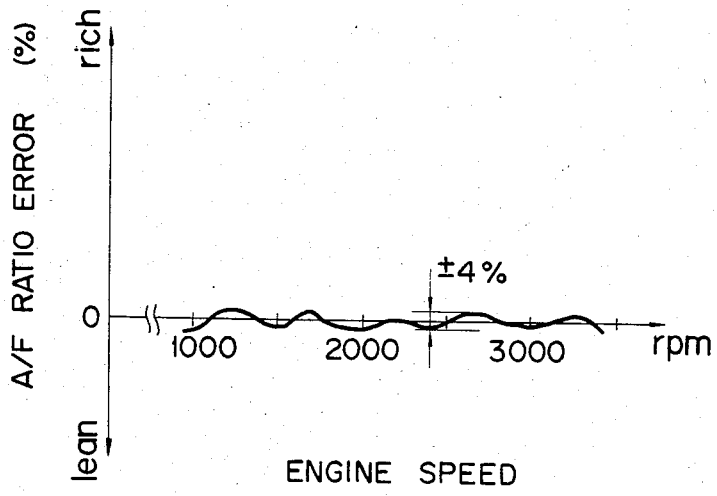
FIGS. 10 and 11 show characteristic curve representing A/F ratio errors obtained with use of the individual corrections.

Therefore, the A/F ratio error may be corrected by only correcting, e.g., a fuel injection quantity $T_p'$ (given by $T_p' = Tp/K3$) as one of the controlled variables of the engine 22. In this case, Tp is a basic fuel injection quantity which is determined by the conventional method without the correction. The A/F ratio error may be corrected with the same result by correcting the mean suction air quantity $\overline{G}$ as another controlled variable of the engine 22 based on the value K3 instead of correcting the value Tp. FIG. 10 shows the result of such correction. As seen from FIG. 10, if the rotational frequency Ne of the engine 22 is less than 3,000 rpm, the A/F ratio error can be limited without ±4%. In FIG. 10, the A/F ratio error for the rotational frequency range over about 3,500 rpm is not clearly shown, since the A/F ratio error attributed to the pulsation of the suction air is basically small when the engine 22 rotates at a speed exceeding about 3,500 rpm, as seen from FIG. 1.

Figure 11:
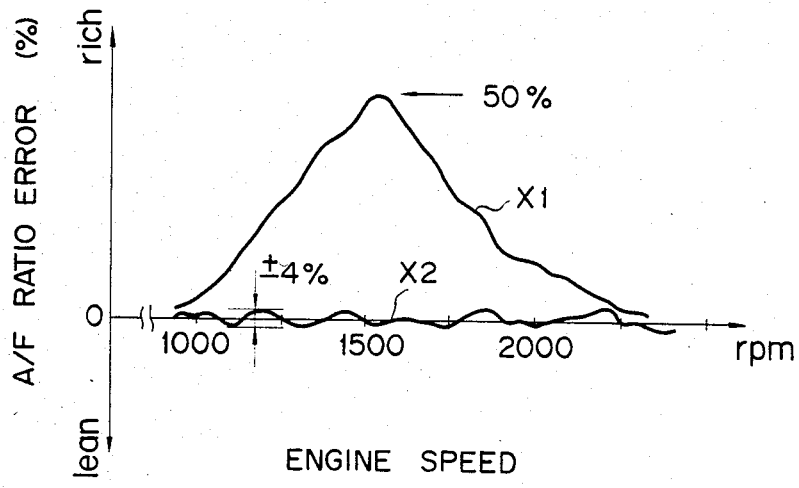

FIG. 11 shows A/F ratio error characteristic curves X1 and X2 before and after correction obtained when the HW sensor 10 is located at a distance of 90 mm from the throttle value 20 and when the throttle valve 20 is fully open.

According to the one embodiment of the present invention, as described above, the fuel injection quantity is corrected with use of a correction which depends on the magnitude of pulsation of suction air, so that the A/F ratio error of the engine can be reduced. Since the correction is additionally corrected by factors peculiar to the suction system of the engine, the A/F ratio errors can further effectively be reduced.

The controlled varaibles of the engine cannot be corrected when the engine is in the high-load and/or unsteady-state operation mode. Thus, wrong correction of the controlled variables can be avoided.

In the aformentioned embodiment of the invention, the fuel injection quantity and other controlled variables of the engine are corrected by the use of the correction. However, the correction may also be used for controlling the ignition timing of the engine on the basis of an engine load. Thus, knocking and variations or reduction of torque may be prevented.

What is claimed is:

1. A method for correcting a controlled variable for the control of the air-fuel ratio of an internal combustion engine comprising:

arranging a thermal type flowmeter in a suction air passage of the engine;

preparing and storing correction data indicating how an output from the thermal type flowmeter is influenced by pulsation of the air flowing through the suction air passage as a function of engine speed;

periodically measuring a quantity of suction air of the engine using the thermal type flow meter;

calculating a differential suction air quantity based on a change in quantity of suction air from one measurement to another, said differential representing a magnitude of pulsation of the suction air;

determining current engine speed; and calculating a correction factor for correcting said controlled variable on the basis of said differential and of said correction data corresponding to current engine speed.

2. A method according to claim 1, wherein said differential calculating step comprises the step of noting a plurality of differentials obtained during a time interval equivalent to an integral multiple of the ignition interval of the engine and using as the calculated differential the greatest value from among the plurality.

3. A method according to claim 1, wherein the correction factor calculating step comprises the step of offsetting said differential by a predetermined value.

4. A method according to claim 1, wherein said step of differential calculating comprises the step of selecting among a plurality of differentials obtained during the ignition interval of the engine the greatest value thereof, and the correction calculating step comprises the step of offsetting said differential by a predetermined value.

5. The method according to claim 1, further comprising the step of deciding whether or not the engine is in a high-load operation mode and reducing the correction obtained in said correcting process to zero if the engine is not in the high-load operation mode.

6. A method according to claim 1, further comprising the step of deciding whether or not the engine is in an unsteady-state operation mode and reducing the correction obtained in said correcting process to zero if the engine is in the unsteady-state operation mode.

7. A method according to claim 6, wherein the deciding step comprises the step of deciding based on whether the sum total of variable suction air quantities obtained at regular time intervals during a time interval equivalent to a predetermined integral multiple of the ignition interval of the engine is not smaller than a predetermined value.

* * * * *